United States Patent [19]

Flanagan et al.

[11] Patent Number: 4,583,544

[45] Date of Patent: Apr. 22, 1986

[54] SPORTS BRA

[75] Inventors: Cherrie Flanagan, Boulder; Arnold I. Gilbert, Eagle-Vail, both of Colo.

[73] Assignee: Gilbert Apparel Group, Inc., Eagle, Colo.

[21] Appl. No.: 783,358

[22] Filed: Oct. 3, 1985

[51] Int. Cl.[4] ..... A41C 3/02; A41D 5/00

[52] U.S. Cl. ..... 128/482; 2/67

[58] Field of Search ..... 128/504, 482, 498, 510, 128/454, 455, 488; 2/67

[56] References Cited

U.S. PATENT DOCUMENTS

| | | | |
|---|---|---|---|
| 3,628,539 | 12/1971 | Fredricks | 128/482 |
| 4,289,137 | 9/1981 | Dell et al. | 128/482 |
| 4,538,614 | 9/1985 | Henderson | 128/482 |

*Primary Examiner*—Doris L. Troutman

*Attorney, Agent, or Firm*—McAulay, Fields, Fisher, Goldstein & Nissen

[57] ABSTRACT

A bra for use, particularly, during participation in sports is provided. The bra has no cups formed in the material, and seams are otherwise avoided. The bra is, essentially, formed as one continuous knitted piece with a two way stretch and the rear of the bra has a height almost the same as that of the front of the bra to provide added support.

8 Claims, 4 Drawing Figures

FIG. 1
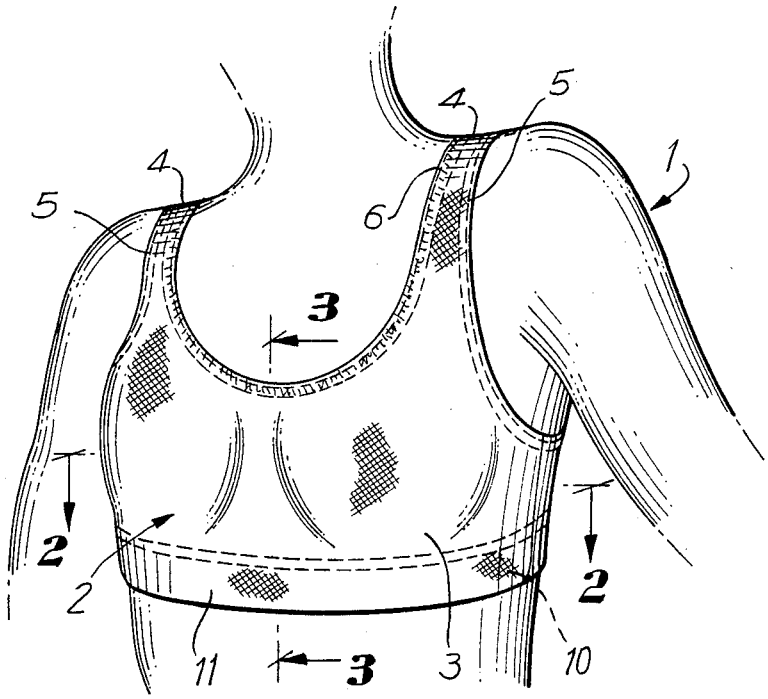
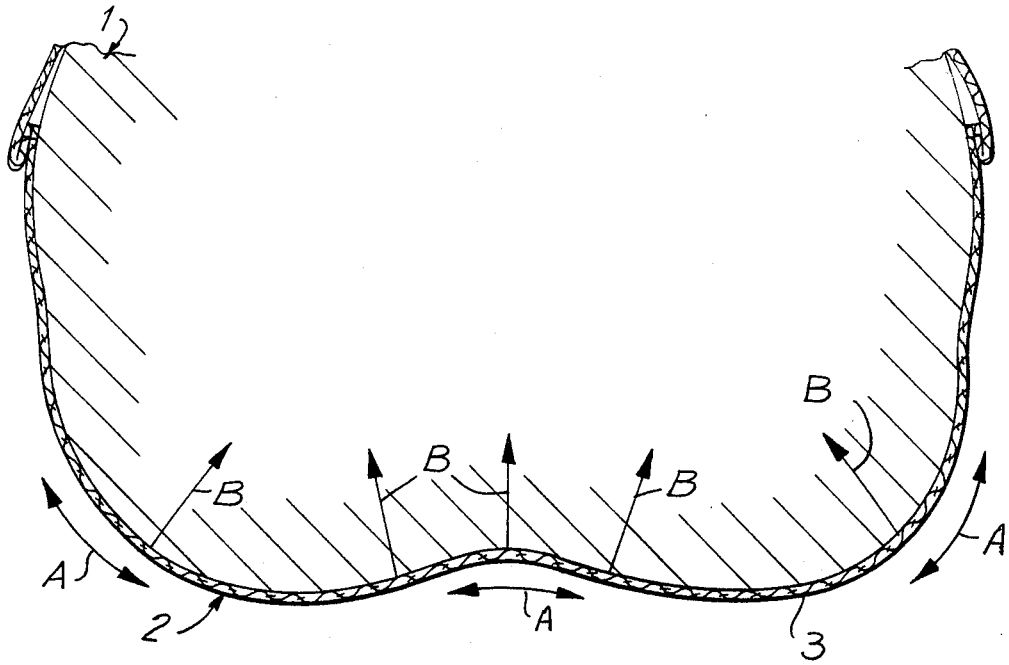
FIG. 2

SPORTS BRA

BACKGROUND OF THE INVENTION

As women compete more in sporting events, or participate more in the leisure time activity of jogging, the construction of brassieres to be used during such times has become increasingly important. Most of the brassieres of the prior art are provided with shaped cups to form and shape the breasts. While this may be desirable from a standpoint of appearance, this does not provide the best type of support when engaged in sporting activities. Further, because of the hardware and/or seams required in the brassiere to create the cups and form, as the breasts move during exercise, chafing is experienced with such a brassiere, making it extremely uncomfortable for use during the referenced leisure time activities. More recently, as the problems of the brassieres of the prior art in sporting activities have become recognized, some brassieres have been made without cups which act, generally, to bind the breasts against the body during sporting activities. Even these, however, as illustrated by U.S. Pat. Nos. 4,174,717 and 4,311,150. Schreiber et al., have certain disadvantages. In particular, they are formed with side panels which not only provide for an additional area of stitching, which provides for an additional area of chafing and irritation, but also preclude the full effect of the brassiere in binding the breasts against the body.

The present invention is directed to a brassiere construction, particularly for use in sporting activities, which provides firm support for the breasts and avoids the irritation and chafing experienced with the brassiere constructions of the prior art.

BRIEF DESCRIPTION OF THE INVENTION

In accordance with the present invention, a brassiere, particularly a brassiere for use during sporting activities is constructed having no seams to irritate the breasts during the sporting activity. A continuous construction is provided from front to back, in the absence of seams, and the brassiere is constructed, generally, of a two way stretch fabric which acts to press the breasts against the body in order to prevent movement which might provide chafing, irritation, or other discomfort. Because of the two way stretch of the fabric, as opposed to a four way stretch which might otherwise be employed, and which is employed in some sports brassieres, better support and better binding of the breasts is accomplished.

Because of the problems which might be encountered if the brassiere were formed with cup shaped members, such members are avoided in the construction of the present brassiere, and, as indicated, it is formed as a continuous band. Additional support is provided through constructing the rear of the brassiere with a height almost that of the front, generally at least 60% of the height of the front. Further, a strong elastic band, without seams, is run continuously around the bottom of the brassiere to provide additional binding and support.

BRIEF DESCRIPTION OF THE DRAWINGS

In the accompanying drawings:

FIG. 1 is an environmental view showing a brassiere in accordance with the present invention in place:

FIG. 2 is a sectional view along the line 2—2 of FIG. 1;

DESCRIPTION OF THE PREFERRED EMBODIMENTS

Figure 4:
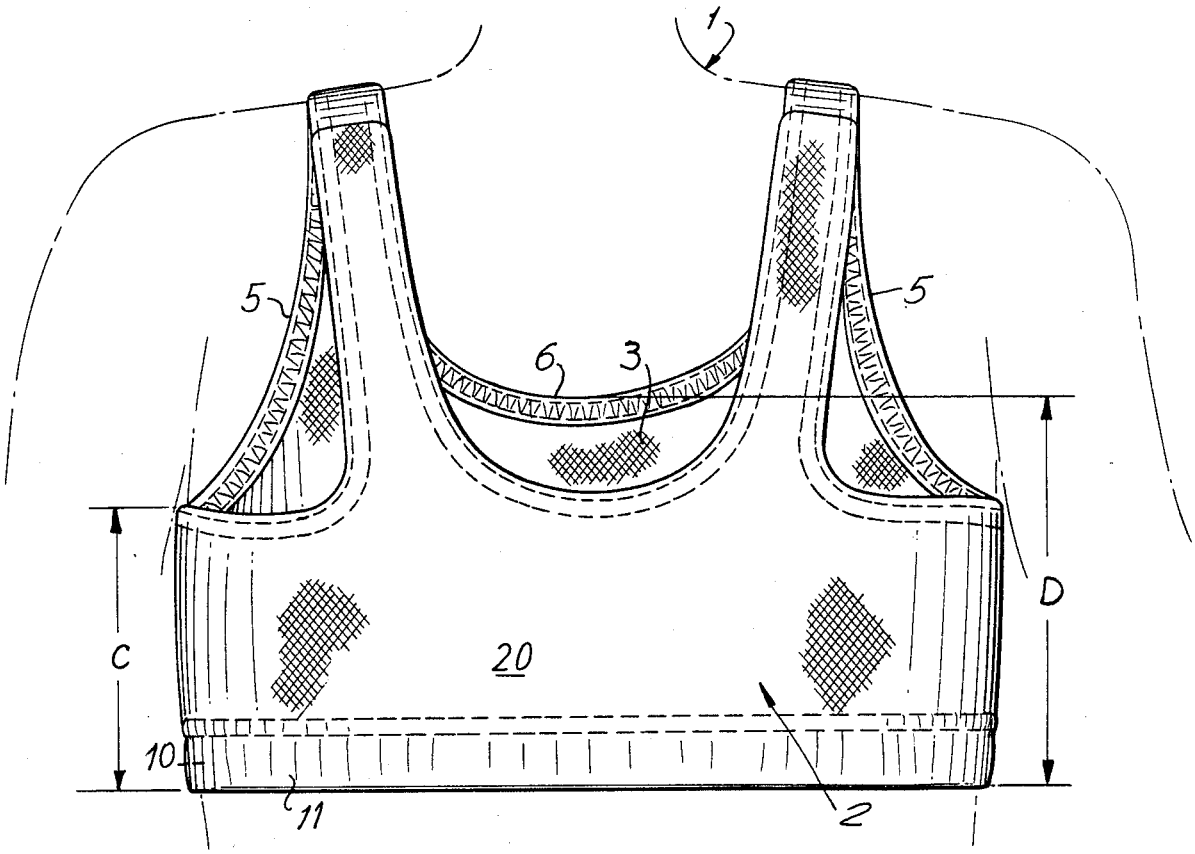
FIG. 4 is a plan view of the brassiere, from the rear.

Referring to the accompanying drawings, a wearer 1 of the brassiere in accordance with the present invention 2 is shown in FIG. 1. As can be seen, the brassiere has a continuous, uninterrupted front panel 3 to which is attached, continuously, shoulder straps 4 which, in combination with the front panel, are edged by covered elastic bands 5 and 6. Affixed to the lower portion of the front panel 3 is another continuous elastic band 10 which is surrounded by the same fabric 11 as the material from which the bra is constructed. As can be seen in FIG. 4, this elastic band 10 continues around the rear of the brassiere, always surrounded by the fabric 11. The continuous elastic band 10 aids in holding the brassiere in place during the movement experienced during sporting activities and also aids in providing support to the breast members.

As previously indicated, the material from which the main panel 3 of the brassiere is constructed is, generally, a two way stretch fabric. The stretch is from side to side as illustrated by the arrows A in FIG. 2. Because of this two way stretch, a force, as illustrated by arrows B, is directed against the breasts to firmly hold them against the body. The absence of a four way stretch, in combination with the elastic band 10, prevents excessive upward and downward movement of the breasts so as to avoid the fatigue and muscle strain which might otherwise be experienced.

Figure 3:
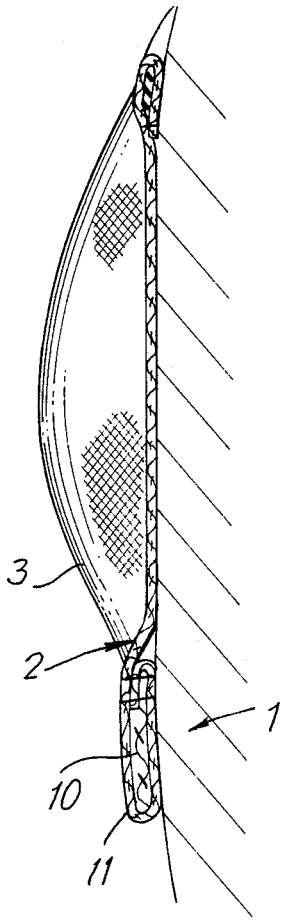
FIG. 3 is a sectional view along the line 3—3 of FIG. 1.

As may be clearly seen from FIGS. 1, 2, and 3, the front panel 3 of the brassiere in accordance with the present invention has no cup forming members. The front panel 3 provides a pocket for the breasts, but the construction of the brassiere acts to bind the breasts against the body, rather than molding or shaping them, an action which would lead to increased irritation, chafing, and strain. As particularly illustrated in FIG. 4, the rear panel 20 of the brassiere which is, essentially, a continuation of the front panel 3, is almost the same height as the height of the front panel 3. Generally, the dimension C is at least 60% of dimension D. Preferably, dimension C is at least 75% of dimension D. By making the rear panel of the bra relatively large, particularly in comparison with the rear panel or strap of the brassieres of the prior art, additional support for the breasts is provided and the force indicated by arrows B can be aimed more directly against the body to aid in binding the breasts, and preventing upward and downward movement of the breasts during sporting activities. Since the rear panel 20 of the brassiere is, essentially, a continuation of front panel 3, it is, obviously, formed of the safe two way stretch material and provides the same advantages as previously set forth.

The elastic bands 5, which surround the arm opening, and 6, which surrounds the neck opening, further aid in holding the brassiere against the body. As indicated, they are essentially continuous bands and are also covered with the fabric from which the brassiere is formed to again aid in the prevention of irritation and chafing.

As indicated throughout this application, the construction of the sporting brassiere of the present invention is one which provides for binding of the breasts against the body during sporting activities, and, in addition, provides support for the breasts while preventing, insofar as possible, upward and downward movement of the breasts. Additional strength, particularly when compared with brassieres of the prior art, is provided by an increased height in the rear panel of the bra which provides for truer direction of forces and additional support. The brassiere is formed, essentially, as a continuous knitted piece in order to avoid seams, and elastic members which are provided for increased support and binding are covered with the fabric of the brassiere as a further means of preventing irritation and chafing.

While specific embodiments of the invention have been shown and described, the invention should be considered as limited only as set forth in the appended claims.

We claim:

1. A sports brassiere comprising:

a. a continuous front panel;

b. a continuous rear panel which is a continuation of said front panel, said rear panel having a height of at least 60% of the height of the front panel;

c. shoulder straps connecting said front panel and said rear panel, said shoulder straps being a continuation of the material of said front and rear panels; and d. an elastic band attached to the bottom of said front and rear panels and extending continuously around said brassiere.

2. The sports brassiere of claim 1 wherein the fabric of construction of said front panel, said rear panel, and said shoulder straps is a two way stretch fabric having a side to side stretch mode.

3. The sports brassiere of claim 1 wherein the height of the rear panel is at least 75% of the height of the front panel.

4. The sports brassiere of claim 1 wherein the continuous elastic band attached to the bottom of the front and rear panels is covered by the same fabric from which the front and rear panels are constructed.

5. The sports brassiere of claim 1 wherein a continuous elastic band surrounds each arm opening.

6. The sports brassiere of claim 5 wherein said elastic band is covered by the same fabric as the material from which the brassiere is formed.

7. The sports brassiere of claim 1 wherein the neck opening of said brassiere is completely edged by a continuous elastic band.

8. The sports brassiere of claim 7 wherein said elastic band is covered by the same fabric as the fabric from which said front and rear panels are formed.

* * * * *